United States Patent [19]

DeRosett

[11] Patent Number: 4,515,335

[45] Date of Patent: May 7, 1985

[54] CANOE LANTERN HOLDER

[76] Inventor: William P. DeRosett, Rte. 4, Box 236A, Livingston, Tenn. 38570

[21] Appl. No.: 523,708

[22] Filed: Aug. 16, 1982

[51] Int. Cl.[3] ..... B63B 17/00

[52] U.S. Cl. ..... 248/231.5; 248/310; 114/347; 114/364

[58] Field of Search ..... 248/205.1, 274, 282, 248/231.5, 310, 640–643; 108/28; 297/194; 114/347, 364, 361; 24/517, 132 WL

[56] References Cited

U.S. PATENT DOCUMENTS

| | | | |
|---|---|---|---|
| 1,100,954 | 6/1914 | Caille | 248/643 |
| 1,288,839 | 12/1918 | Conrad . | |
| 2,430,161 | 11/1947 | Csencsics . | |
| 2,475,889 | 7/1949 | Hafele | 248/641 |
| 2,559,003 | 7/1951 | Brow | 248/310 |
| 2,655,337 | 10/1953 | Diesfeld . | |
| 2,669,733 | 2/1954 | Picker | 114/264 |
| 2,846,201 | 8/1958 | Mermelstein | 248/311.2 |
| 2,867,403 | 1/1959 | Graf . | |
| 2,872,146 | 2/1959 | Kukla | 248/310 |
| 2,875,974 | 3/1959 | Albert | 248/310 |
| 3,601,344 | 8/1971 | Nourse | 248/641 |
| 3,745,329 | 7/1973 | Runey, Jr. . | |
| 3,896,832 | 7/1975 | Montoya | 114/361 |
| 3,918,666 | 11/1975 | Florian | 248/641 |
| 3,941,072 | 3/1976 | Caton | 248/642 |
| 4,395,013 | 7/1983 | Wissinger | 248/311.2 |

FOREIGN PATENT DOCUMENTS

| | | | |
|---|---|---|---|
| 650282 | 10/1962 | Canada | 248/641 |
| 721977 | 11/1965 | Canada | 114/364 |
| 638983 | 6/1928 | France | 248/311.2 |

*Primary Examiner*—William H. Schultz
*Assistant Examiner*—Robert A. Olson
*Attorney, Agent, or Firm*—Herman L. Holsopple, Jr.

[57] ABSTRACT

A holder for mounting gasoline or kerosene lanterns on canoes which comprises a trapezoid-shaped retentive base designed to slip over and be retained in a horizontal plane in the tapered end of the canoe and having a compressible cylindrical receptacle sized to fit said lantern base and attached fixedly to said retentive base and means for securing said lantern therewithin. The holder is readily adjustable to fit canoes having different bow or stern configurations.

1 Claim, 5 Drawing Figures

CANOE LANTERN HOLDER

BACKGROUND OF THE INVENTION

This invention relates generally to improvements in lantern holders for boats and, more specifically, to lantern holders adaptable for mounting lanterns on canoes.

In the past, sportsmen, including hunters, fisherman and campers, have had to improvise means for mounting lights such as flashlights and lanterns on the sides or ends of small fishing boats in order to navigate at night or to provide light for night fishing. This has led to the development of several different lantern holders and lantern brackets for small boats such as those described in U.S. Pat. Nos. 2,430,161, 2,655,337, 2,867,403 and 3,745,329. All of these lantern supports were designed to fixedly retain a lantern on the sides of small fishing boats, particularly those known as row boats.

Because of their easy portability, more and more outdoorsmen are increasingly utilizing canoes for their recreational activities. Being light in weight, canoes can be transported on car top carriers and, ordinarily, may be launched by one person. However, in the past, there has been no convenient method for mounting gasoline or kerosene lanterns on the front or rear end of a canoe.

Accordingly, it is the primary object of this invention to provide a holder for gasoline lanterns of a type such as the popular "Coleman" lantern whereby said lantern can be safely and securely mounted to the bow or stern (if double-ended) portion of a canoe.

A further object of this invention is to provide a novel lantern holder for canoes which is readily portable and which may be quickly and easily engaged or disengaged from the canoe.

Still another object of this invention is to provide a universal lantern holder for canoes which is readily adjustable to fit canoes having different bow or stern configurations.

It is yet another object of the invention to provide a unique lantern holder for canoes which is inexpensive to manufacture from weatherproof materials and which is convenient and safe to use.

Practical embodiments of the subject invention are shown in the accompanying drawings in which the several parts are similarly designated in each view.

DETAILED DESCRIPTION OF THE PREFERRED EMBODIMENT

Figure 1:
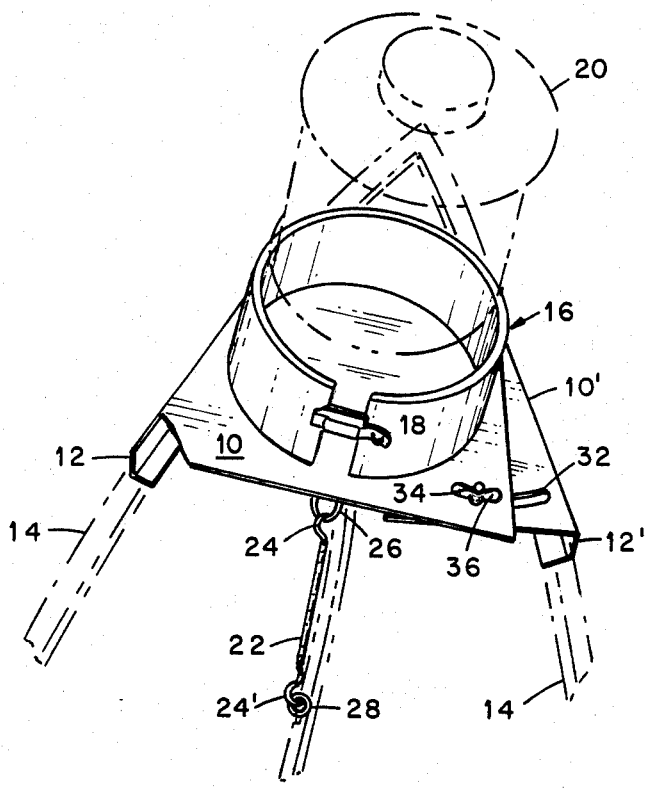
FIG. 1 is a top perspective view of the subject canoe lantern holder looking toward the bow of a canoe and showing the manner in which said holder may be mounted on the bow.
Figure 2:
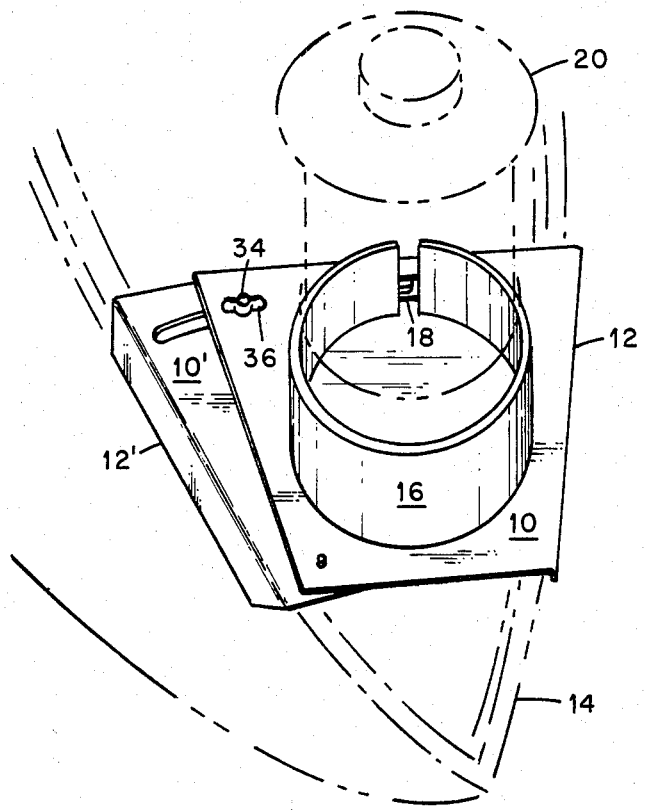
FIG. 2 is a top perspective view of the device of the invention looking toward the stern of a canoe.

Referring to the perspective views of FIGS. 1 and 2, the invention is seen to comprise, in general, a trapezoid-shaped two-piece sheet-metal base plate assembly 10, 10' having two channel edges 12, 12' formed thereon, respectively, and adapted to encase and be retained by the gunwales 14 of the bow or stern of a canoe; an upper cylindrical receptacle 16 mounted to base plate assembly 10, said receptacle 16 being the lantern-retaining portion and having a spaced opening for latch 18 whereby cylindrical receptacle 16 may be tightly compressed upon lantern 20 and whereby lantern 20 is releasably retained therewithin; a strap attachment 22 having hooks 24, 24' on each end thereof, being connected, respectively, to an eye or hook 26 in the aft portion of plate 10 and to an eyelet 28 in the bottom of the canoe whereby the subject lantern holder is releasably secured thereto. It should be noted that strap attachment 22 does not necessarily need to be attached to eyelet 28 but may be attached to any convenient existing structures on some canoe models. Strap attachment 22 is preferably constructed of any resilient material such as an elastic fabric or metal spring.

Since it is the purpose of the subject invention to provide a device which may be utilized on any canoe and since canoes have varying end configurations, a preferred embodiment of base plate 10 is shown in FIGS. 1 and 2 which comprise manufacturing said trapezoid-shaped sheet-metal base plate assembly 10 in two sections, designated as 10 and 10'. The larger base plate section 10 is pivoted at its narrower forward end to the narrow forward end of a smaller base plate section 10' by a pin 30. Smaller base plate section 10' has a slot 32 therethrough aligned to receive bolt 34 whereby said smaller base plate 10' can be adjusted to conform to the configuration of the gunwales 14 of the canoe. By tightening wing nut 36 onto bolt 34, the two base plate sections 10, 10' are securely and fixedly attached to each other and to the gunwales 14 of any canoe.

As seen in the drawings, the subject lantern holder is designed and sized to be retained on the pointed bow end of a canoe by slidably engaging the two channel edges 12 of base plate assembly 10 onto the gunwales 14 of the canoe. Said channel edges 12 are on opposite nonparallel sides of the base plate assembly and are turned downward and inward to conform to the shape of said gunwales. When properly positioned, the rearward motion of the lantern holder is limited by the pressure of the canoe gunwales 14 into channel edges 12 while forward motion is prevented by attaching strap attachment 22 to eyelet 26 in base plate assembly 10 by means of hook 24 on a first end and to eyelet 28 in the floor of the canoe by a hook 24' on a second end of strap attachment 22.

In use, the base of a lantern having the general configuration of cylindrical receptacle 16 is placed therein whereupon latch 18 is engaged and closed in place. The engagement and closure of latch 18 compresses cylindrical receptacle 16 tightly upon the base of lantern 20 whereupon said lantern is frictionally retained therein. As seen in the drawings, the height of cylindrical receptacle 16 does not need to be large in relation to its diameter.

The subject invention may be easily fabricated from sheet metal using conventional welding or riveting techniques. It is anticipated, however, that a more convenient and less expensive method of manufacture might comprise die casting the parts using a sturdy high-impact plastic.

Figure 3:
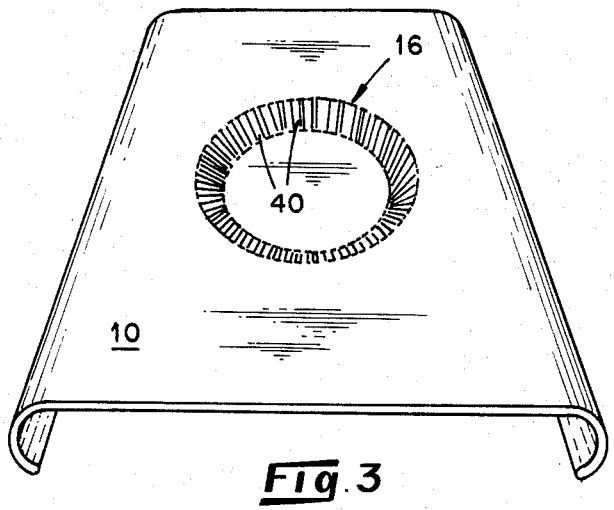
FIG. 3 is an isometric view of a second embodiment of the invention.
Figure 4:
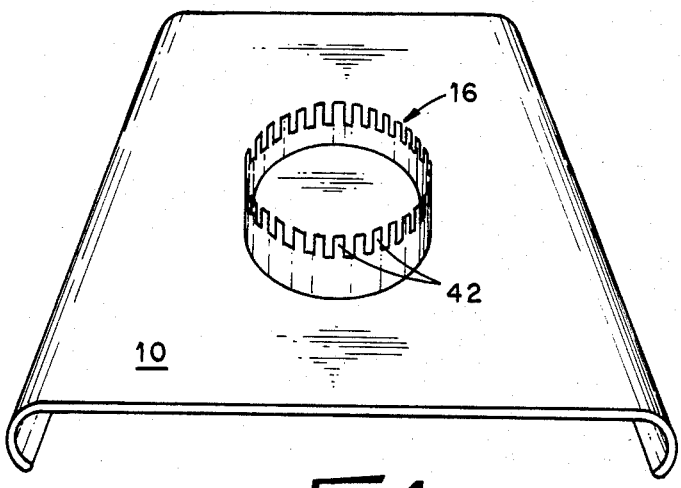
FIG. 4 is an isometric view of a third embodiment of the invention.

Accordingly, two embodiments utilizing die casting or molding techniques are shown in FIGS. 3 and 4. The single-piece plastic casting of FIG. 3 shows cylindrical receptacle 16 as being recessed blow the horizontal plane of base plate assembly 10 and as having a multiplicity of raised vertical ribs 40 on the inner surface thereof for frictionally engaging the base of a lantern of the Coleman type.

FIG. 4 shows a single-piece casting of the invention wherein cylindrical receptacle 16 is raised above the horizontal plane of plastic base plate assembly 10 and is provided with a multiplicity of vertical slots 42 circumferentially through the wall whereby a lantern may be frictionally retained by the elastic resilience of said slotted surface.

Figure 5:
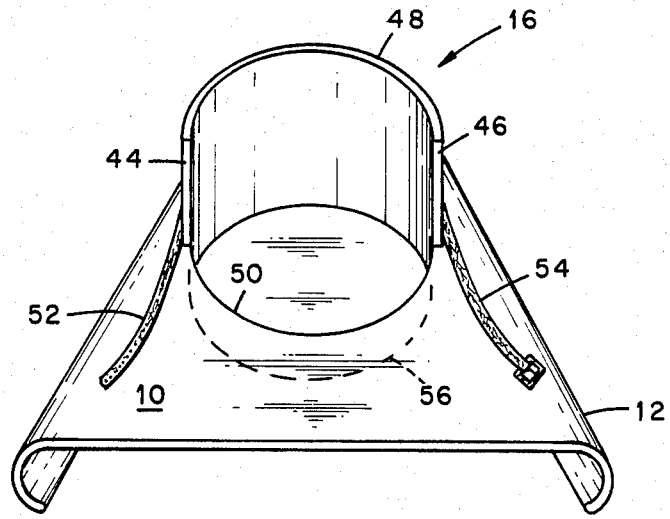
FIG. 5 is an isometric view of a fourth embodiment of the invention.

It is an important feature of the invention that the cylindrical receptacle 16 portion of the lantern holder not be limited to a single size or brand of lantern. In accordance with this objective, a final embodiment of the invention is shown in FIG. 5 wherein the cylindrical receptacle 16 is transversely split to present a pair of opposed free ends 44, 46 with two hemispherical halves, a high-sided half 48 and a low-sided half 50, and having the two cooperative ends of a belt 52, 54 attached to free ends 44, 46, respectively, of said high-sided half 48 whereby a lantern of any size can be securely strapped therein. The embodiment of FIG. 5 may be die-cast, molded or manufactured by other conventional means. Alternatively, the low-sided portion 50 of the cylindrical lantern receptacle may be recessed into base plate 10, if desired.

It will be seen from the foregoing description and drawings that a simple and effective means is provided for securely mounting a gasoline or kerosene lantern to a canoe in a substantially horizontal plane. No extraneous fasteners or clamps are required which might damage or mar the surface finish of the boat. Further, the lantern is retained within the gunwales of the canoe whereby it cannot be accidentally knocked loose by contact against a dock or other vessel.

A preferred embodiment of this invention has been set forth in the description and drawings. These descriptions are used in the generic sense and not for purposes of limitation. Spacers of any convenient configuration, for example, may be provided for insertion into the cylindrical receptacle whereby a lantern of smaller than normal dimensions may be securely accommodated. Various design and structural changes may be made in the described components without departing from the spirit and scope of the invention.

What is claimed is:

1. A holder for mounting lanterns on boats comprising: a base plate assembly formed from weatherproof material and defining a generally trapezoid-shaped surface, said base plate assembly having a first larger trapezoid-shaped surface with a narrower forward end and a second smaller trapezoid-shaped surface with a narrower forward end, said larger base plate portion being pivotally mounted at said narrower forward end to said narrower forward end of said smaller base plate portion; a bolt mounted in said first surface, said bolt aligned to move through a slot in said second surface whereby said first and second surfaces are adjustable to conform to the end configuration of the gunwales of the boat and whereby said holder is secured by a nut on said bolt; a compressible cylindrical receptacle vertically mounted upon said base plate assembly, a latch within a spaced opening in said cylindrical receptacle being operable to compressibly retain a lantern therewithin; and two channel edges on the opposite nonparallel sides of said base plate assembly, said channel edges turned downward and inward to conform to the shape of the gunwales of the boat, said channel edges, together with a strap adapted to be attached from the aft portion of the holder to an eyelet in a floor of the boat, being operable to retain said holder thereon.

* * * * *